United States Patent [19]

Kawabata et al.

[11] Patent Number: 4,879,873

[45] Date of Patent: Nov. 14, 1989

[54] SPINNING UNIT IN OPEN-END SPINNING MACHINE

[75] Inventors: Susumu Kawabata; Tetsuzo Inoue; Hiroshi Niimi, all of Aichi, Japan

[73] Assignee: Kabushiki Kaisha Toyota Chuo Kenkyusho, Aichi, Japan

[21] Appl. No.: 225,735

[22] Filed: Jul. 29, 1988

[30] Foreign Application Priority Data

Jul. 31, 1987 [JP] Japan ..... 62-93065

[51] Int. Cl.[4] ..... D01H 7/892; D01H 7/882

[52] U.S. Cl. ..... 57/413; 57/408; 57/411

[58] Field of Search ..... 57/404, 408, 413

[56] References Cited

U.S. PATENT DOCUMENTS

| | | | |
|---|---|---|---|
| 3,368,340 | 2/1968 | Barsukov et al. | 57/411 |
| 3,538,698 | 11/1970 | Ripka et al. | 57/413 |
| 3,785,138 | 1/1974 | Rajnoha et al. | 57/413 |
| 4,291,528 | 9/1981 | Miyamoto et al. | 57/413 X |
| 4,339,910 | 7/1982 | Ali et al. | 57/411 |
| 4,471,608 | 9/1984 | Kawabata et al. | 57/411 X |
| 4,625,506 | 12/1986 | Beckers | 57/413 |

FOREIGN PATENT DOCUMENTS

| | | |
|---|---|---|
| 60-119230 | 6/1985 | Japan . |
| 2054671 | 2/1981 | United Kingdom . |

*Primary Examiner*—John Petrakes

*Attorney, Agent, or Firm*—Oblon, Spivak, McClelland, Maier & Neustadt

[57] ABSTRACT

A spinning unit of an open-end spinning machine is disclosed which comprises a rotor having an inner wall, a bottom portion and an open end opposite to said bottom portion and arranged to rotate about a center axis perpendicular to said bottom portion; and a stationary closing member projecting into a spinning chamber of said rotor to thereby close the open end of said rotor and provided with a fiber supply duct which opens toward the inner wall of the rotor, and a yarn guide hole which opens in an end surface thereof opposite to the bottom portion of the rotor. The fiber supply duct is arranged in the closing member so that an inner wall of the fiber supply duct located on a side of the rotational center of the rotor is extended to be near to the rotational center of the rotor or to be over the rotational center of the rotor. The width of the fiber supply duct is established to be not larger than 90 percent of the diameter of the closing member.

7 Claims, 14 Drawing Sheets

SPINNING UNIT IN OPEN-END SPINNING MACHINE

FIELD OF THE INVENTION

The present invention relates to, in a spinning unit of an open-end spinning machine, a structure of a fiber supply duct and an outlet position of a yarn guide hole for drawing out a bundle of fibers collected in a greatest inner-diameter portion of a rotor in the form of a yarn.

BACKGROUND OF THE INVENTION

Generally, in the conventional open-end spinning machine shown in FIG. 1, a bundle of fibers, that is, a sliver 3 supplied through an inlet 2 of a spinning unit 1 is transported to a combing roller 6 by means of a feed roller 4 in cooperation with a presser 5 which presses the sliver 3 onto the feed roller 4. Then, the sliver 3 is opened into individual fibers by the combing roller 6 and, at the same time, impurities 7, such as leafage, trash and the like, are expelled through an outlet 8. The opened fibers are transported to a spinning chamber 10 of a high-speed rotor 9 through a fiber supply duct 11 by an airstream Y created by negative pressure in the spinning chamber 10 of the rotor 9 rotating at high speed. The fibers thus transported into the spinning chamber 10 reach an inner wall 9*a* of the rotor 9 through a circular stream created in the spinning chamber 10 by the working of the rotor 9 rotating at high speed. Then the fibers slide toward a fiber-collecting portion 13 which is the greatest inner-diameter portion. In the fiber-collecting portion 13, the fibers are collected and twisted in the shape of a ribbon. The fiber ribbon is drawn out in the form of a yarn 31 through a yarn guide hole 14 which is provided in the center of a closing member 20.

The rotor 9 has the spinning chamber 10 closed by the inner wall 9*a* and a bottom portion 9*b*. An open end of the spinning chamber 10 opposite the bottom portion 9*b* is substantially closed by the closing member (boss portion) 20 formed by part of the frame of the spinning unit 1. The closing member 20 projects into the spinning chamber 10 of the rotor as a boss portion in which an opening portion 111 of the fiber supply duct 11 and a yarn guide opening portion 141 of the yarn guide hole 14 are provided, respectively. Here, in order to draw the fibers into the spinning chamber 10 through the fiber supply duct 11, it is necessary to provide negative pressure in the spinning chamber 10 to form an airstream toward the spinning chamber 10 from the fiber supply duct 11.

There are three kinds of systems for airstream formation. A first system is of the force exhaustion type in which the air in the spinning chamber 10 is sucked out from an upper-side opening end of the rotor by a suction means (not shown) connected to an exhaust port 16 provided in a casing 15 covering the rotor 9. A second system is of the self-exhaustion type in which the air in the spinning chamber 10 is expelled through a plurality of exhaust ports 9*c* provided radially in the bottom portion 9*b* of the rotor 9 by centrifugal force imparted by the rotor 9. A third system is of the self-and-forced exhaustion type in which the forced exhaustion and the self-exhaustion are used in combination.

On the other hand, a channel system and a separator system are now used as means for supplying fibers into the spinning chamber 10. The channel system is of the type in which the fibers are supplied into the spinning chamber 10 through the opening portion 111 provided on a side wall of the boss portion 20 so that the opening portion 111 directly faces the inner wall 9*a* of the rotor as shown in FIG. 1. The separator system is of the type in which the fibers are supplied into the spinning chamber 10 through the opening portion 111 provided on an end surface of a semicircular slit 201 (FIG. 20 and FIG. 21) formed in a side wall of the boss portion 20 as shown in FIGS. 11 through 13.

In those systems of open-end spinning machines, the high-speed revolution of the rotor (about 50,000 to 100,000 rpm) has been progressed. With the progress of the revolution speed of the rotor, the diameter of the rotor has decreased. The necessity of reducing the diameter of the rotor with the progress of the revolution speed of the rotor is due to the following reason.

As shown in FIG. 23, the spinning tension F applied to the yarn is represented by the equation:

$$F=(\tfrac{1}{2})\times\rho(D/2)^2\omega^2 e^{\mu(\theta 1+\theta 2)}$$

where $\rho$ represents the linear density (kg/m) of the yarn, D represents the greatest inner-diameter (m) of the rotor, $\omega$ represents the angular velocity (rad/s) of the rotor, $\mu$ represents the coefficient of frictional between the yarn and the guide, and $\theta_1$ and $\theta_2$ represent the contact angles (rad) between the yarn and the guide when the yarn is drawn out.

Let the revolution speed of the rotor now be increased, then the tension F applied to the yarn increases in proportion to a square of the revolution speed of the rotor. When the tension F increases, end breakage occurs during spinning or the elasticity of the yarn thus produced is lost. The large tension F has an adverse influence on the handling of the spinning machine and the quality of the yarn. The diameter of the rotor must be reduced in order to attain high-speed revolution of the rotor.

Although the diameter of the rotor has been reduced with the progress of the high-speed revolution of the rotor, over-reduction of the diameter of the rotor to attain higher-speed revolution of the rotor induces yarn evenness and lowering of yarn strength so as to deteriorate the quality of the yarn.

Investigating the cause, the yarn guide passage (yarn guide hole) in the prior art is arranged in the center of the end surface of the boss portion in the conventional system. Therefore, it is necessary to arrange the fiber supply duct (channel passage) 11 to avert the yarn guide hole 14. Because the diameter of the boss portion 20 decreases as the diameter of the rotor decreases, the size of the fiber supply duct 11 is limited by the size of the boss portion 20. In short, the sectional area of the fiber supply duct must be reduced as the diameter of the rotor decreases as shown in FIG. 24. The same tendency exists both in the case of a channel system and in the case of a separator system. Accordingly, the following description is made only for the case of a channel system.

When the sectional area of the channel passage decreases as the diameter of the rotor decreases, air resistance increases, so that the air flow from the channel passage decreases. Consequently, the fibers flying within the channel cannot be placed on the airstream well so that the fibers are bent by collision with the wall of the channel to thereby shorten effective fiber length or the fibers during flying are entangled with each other to thereby produce yarn evenness.

SUMMARY OF THE INVENTION

It is an object of the present invention to eliminate the problems in the prior art and to provide a spinning unit in which fibers flying within a fiber supply duct can be smoothly supplied into a rotor in spite of reduction in size of the rotor, thereby producing a good quality yarn.

According to an aspect of the invention, the spinning unit of an open-end spinning machine comprising a rotor having an inner wall, a bottom portion and an open end opposite to the bottom portion and being arranged to rotate about a center axis perpendicular to the bottom portion, and a stationary closing member projecting into a spinning chamber of the rotor to thereby close the open end of the rotor and being provided with a fiber supply duct which opens toward the inner wall of the rotor, and a yarn guide hole which opens in an end surface thereof opposite the bottom portion of the rotor, is characterized in that the fiber supply duct is arranged in the closing member so that an inner wall of the fiber supply duct located on a side of the rotational center of the rotor is extended to be near to the rotational center of the rotor or to be over the rotational center of the rotor, and in that the width of the fiber supply duct is established to be not larger than 90 percent of the diameter of said closing member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several view and wherein:

FIGS. 10 through 13 show a first embodiment according to the present invention, in which:

FIG. 10 is a vertical sectional view thereof,

FIG. 11 is a sectional view taken along the line F—F of FIG. 10,

FIG. 12 is a vertical sectional view; and

FIG. 13 is a sectional view taken along the line G—G of FIG. 12;

FIGS. 15 through 18 show a third embodiment according to the invention, in which:

FIG. 15 is a view showing the eccentric of the yarn guide opening portion and the area of the upper end of the closing member;

FIG. 16 is a partly sectional view of the closing member;

FIG. 17 is a view showing the angle of rotation of the yarn; and

FIG. 18 is a view showing the relation between the angle of rotation of the yarn and the tension thereof;

FIGS. 20 through 24 show a conventional separator-type spinning unit, in which:

FIG. 20 is a partly sectional view thereof,

FIG. 21 is a sectional view taken along the line X—X of FIG. 20,

FIG. 22 is a view showing the position of the yarn guide opening portion in the upper end of the closing member;

FIG. 23 is a view showing the condition that the yarn is drawn out; and

FIG. 24 is a view showing the relation between the diameter of the rotor and the sectional area of the fiber supply duct.

DESCRIPTION OF THE PREFERRED EMBODIMENTS

In the foregoing conventional spinning unit of an open-end spinning machine, the spinning unit is characterized in that the yarn guide hole has a yarn guide opening portion which opens toward the bottom portion of the rotor, the center of the yarn guide opening portion being eccentrically arranged at a distance from the rotational center of the rotor.

The present inventors have made investigation and analysis of a method for avoiding reducing the sectional area of the fiber supply duct in spite of reduction in size of the rotor or in other words a method for enlarging the ratio of the sectional area of the fiber supply duct to the diameter of the rotor. The investigation and analysis have resulted in the present invention as described below.

Figure 1:
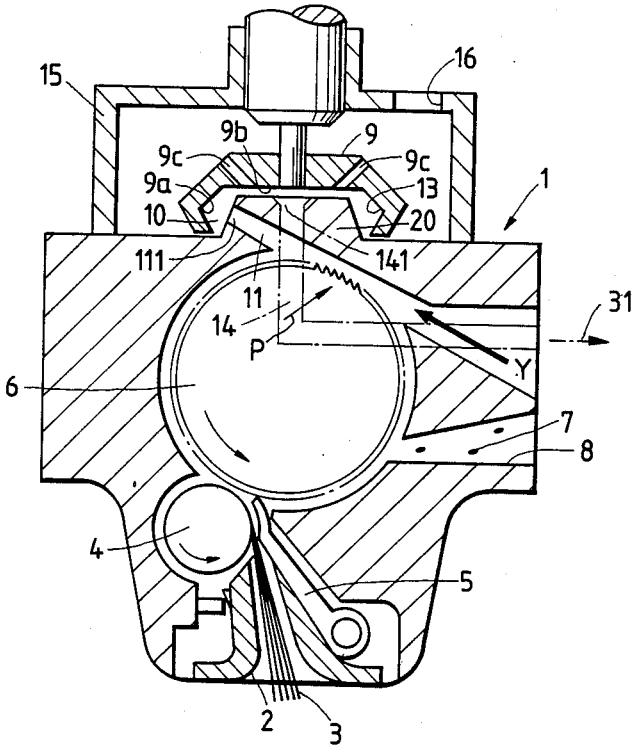
FIG. 1 PRIOR ART
FIG. 1 is a sectional view for explaining a prior art spinning unit in an open-end spinning machine.
Figure 2:
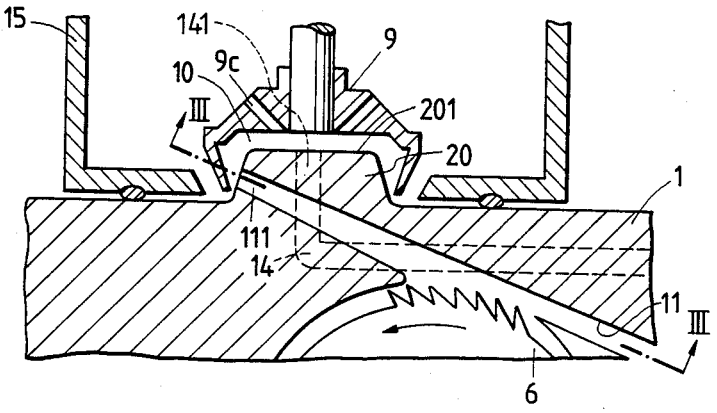
FIGS. 2 and 3 show the relation in position in the prior art between the fiber supply duct and the yarn guide opening portion, FIG. 2 being a vertical sectional view thereof, FIG. 3 being a sectional view taken along the line III—III of FIG. 2.
Figure 3:
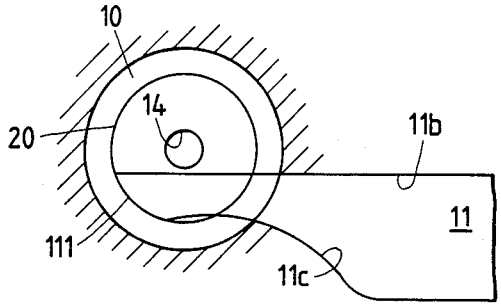
Figure 4:
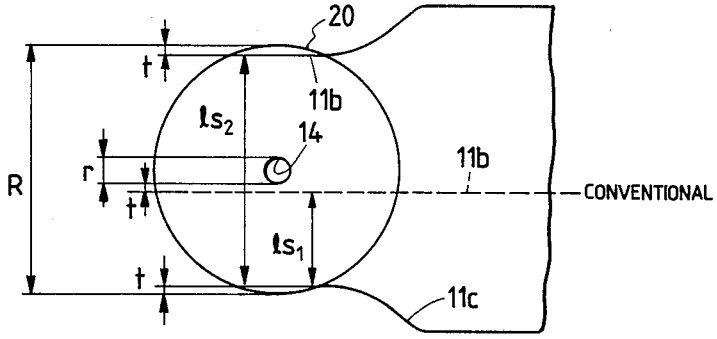
FIG. 4 is a view illustrating a comparison of the present invention and the prior art and; showing the relation in position between the fiber supply duct and the yarn guide opening portion.
Figure 10:
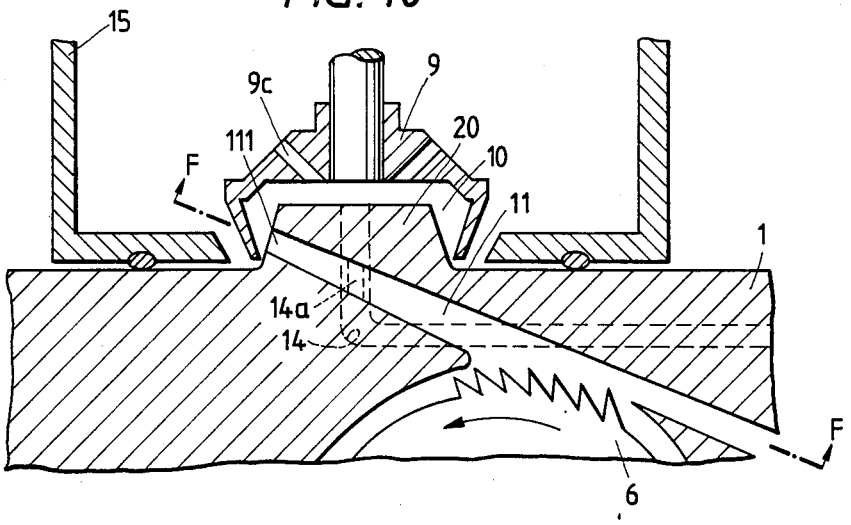
Figure 11:
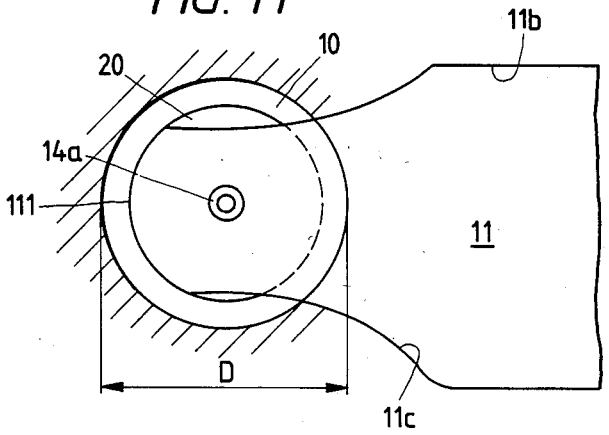

As previously discussed, it has been found that the size of the fiber supply duct in the prior art is limited by the yarn guide opening portion arranged in the center of the end portion of the closing member. According to various examinations about the method for enlarging the fiber supply duct opening toward the inner wall or bottom portion of the rotor, the aforementioned problems are solved by providing a side wall **11*b* (which is near the center of the end portion 201 of the closing member 20 opposite to the bottom portion of the rotor or in other words near the center of the rotor) of the fiber supply duct 11 near to or over the rotational center of the rotor as shown in FIG. 10 and FIG. 11, as compared with the conventional case where the fiber supply duct 11 is arranged to avert the yarn guide hole 14 as shown in FIGS. 2 and 3**.

Where ls is the width of the fiber supply duct as shown in FIG. 4, then the sectional area Sl of the fiber supply duct is considered to be a function of ls. In the drawing, the width $ls_1$ of the fiber supply duct in the conventional case where the fiber supply duct is arranged to avert the yarn guide hole is represented by the equation:

$$l s_1=(\tfrac{1}{2})(R-r)-2t$$

where R is the diameter of the boss portion, r is the diameter of the yarn guide hole opening at the center of the end surface of the boss portion, and t is the minimal thickness necessary for making the fiber supply duct open. When the side wall of the fiber supply duct near to the rotational center of the rotor is extended over the rotational center of the rotor, the width $ls_2$ of the fiber supply duct can be enlarged to $ls_2=R-r_0-2t$ as a maximum.

Accordingly, though $ls_1$ in the conventional case is within the following range:

$$0<l s_1\leqq(\tfrac{1}{2})(R-r)-2t$$

$ls_2$ in the present invention can be enlarged to be within the following range:

$$0<ls_2\leqq(R-r_0-2t).$$

Particularly, the widening factor $l_R$ represented by the equation:

$$l_R=l_{s2}lS_1$$

is within the following range:

$$(\tfrac{1}{2})(R-r)-2t<lR\leqq(R-r_0-2t).$$

Figure 5:
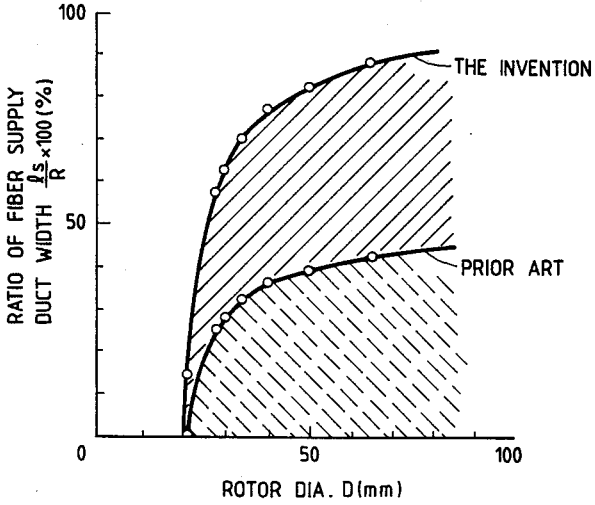
FIG. 5 is a view illustrating a comparison of the present invention and the prior art and showing the relation between the diameter of the rotor and the percentage in width of the fiber supply duct.

FIG. 5 shows the ratio of the width ls of the fiber supply duct to the diameter R of the boss portion when the diameter D of the rotor varies for t=0.15 mm and r=5 mm or, in other words, FIG. 5 shows $ls_1/R$ and $ls_2/R$. It is apparent from the drawing that the width ls in the case of the present invention as shown by the oblique line is relatively widened as compared with that in the conventional case as shown by the broken line.

Figure 6:
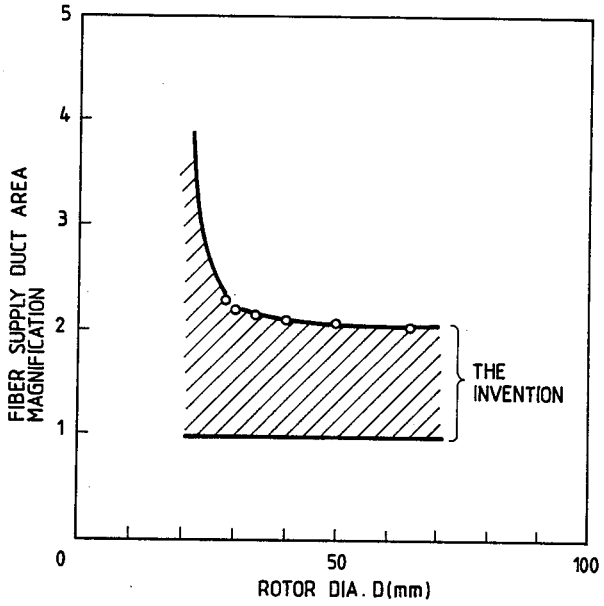
FIG. 6 is a view of the present invention showing the relation between the diameter of the rotor and the magnification in area of the fiber supply duct.

As ls is widened, the sectional area Sl of the fiber supply duct is enlarged. FIG. 6 shows the magnification of the sectional area of the fiber supply duct in the present invention relative to that in the conventional case, with respect to various values of the diameter of the rotor. The sectional area of the fiber supply duct can be enlarged to twice the maximum by widening the width thereof. Particularly, the magnification increases as the diameter of the rotor decreases. This is advantageous to the reduction in size of the rotor as one object of the present invention.

Further, in the present invention, the aforementioned problems are solved by moving the center of the yarn guide opening portion 111 to an outer position and arranging it eccentrically by a distance from the rotational center of the rotor, compared with the conventional case where the yarn guide opening portion opens in the center of the end portion of the closing member.

Figure 7:
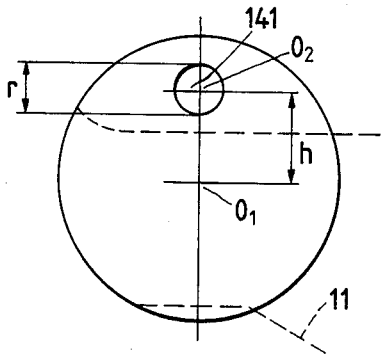
FIG. 7 is a view of the present invention showing the eccentric condition of the yarn guide opening portion in the upper end of the closing member.
Figure 14:
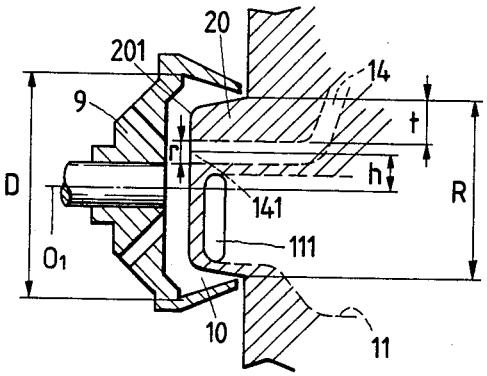
FIG. 14 is a partly sectional view of the closing member showing a second embodiment according to the invention.

Describing in detail as shown in FIG. 7 and FIG. 14, the yarn guide opening portion 141 which, in the conventional case, opens in the center position $O_1$ (which is located on the rotational center axis of the rotor) of the end portion 201 of the closing member 20 is moved to an outer position $O_2$ by a distance h from the center, so that the fiber supply duct can be widened corresponding to the displacement h of the yarn guide opening portion.

When the yarn guide opening portion is arranged eccentrically by h with respect to the rotational center of the rotor, the tension F applied to the yarn, however, changes periodically with time as represented by the following equation:

$$F=(\tfrac{1}{2})\times\rho(D/2)^2\times\{-h\cdot\cos\omega t/(D/2)+\sqrt{1-[h/D/s-]^2\times\sin^2\omega t}\}^2\times\omega^2e^{\mu(\theta_1+\theta_2)}$$

Accordingly, it has been considered in the conventional case that the yarn guide opening portion must be located on the rotational center axis of the rotor.

Therefore, the inventors have thoroughly investigated the influence of the tension variations on the quality (i.e. irregularity of thickness and yarn strength) of the yarn and the production of the yarn to examine whether the aforementioned condition is essential or not. First, the relation between the eccentricity of the yarn guide opening portion and the quality of the yarn has been examined experimentally.

Figure 8:
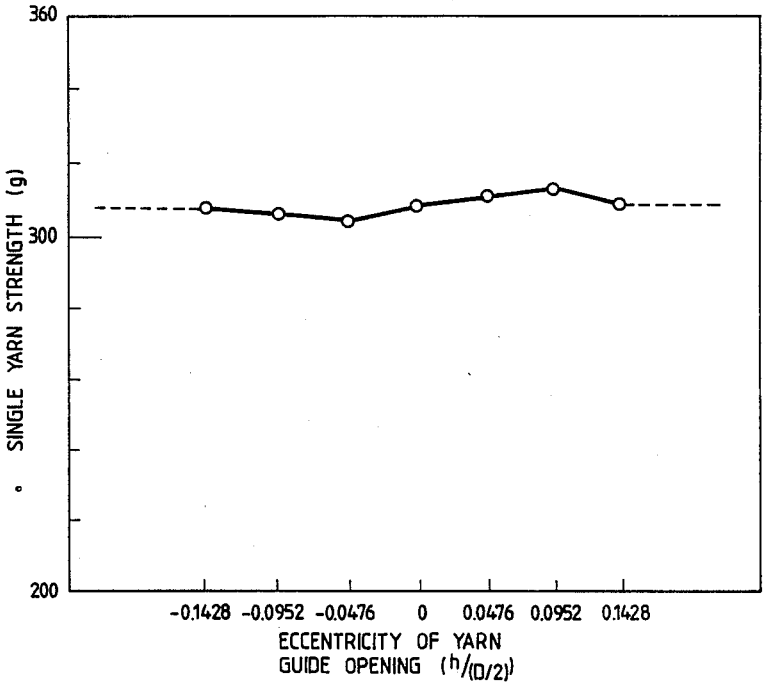
FIGS. 8 and 9 are views of the present invention showing the relation between the eccentricity of the yarn guide opening portion and the strength of a single yarn and the relation between the eccentricity of the yarn guide opening portion and the irregularity of thickness, respectively.
Figure 9:
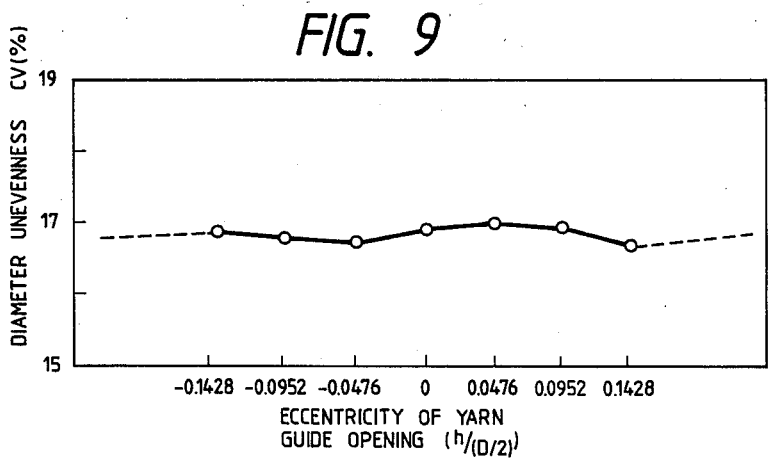

The results of examination are shown in FIGS. 8 and 9. In the drawings, the x-distance represents the eccentricity [h/(D/2] of the yarn guide opening portion. When h/(D/2)=0, the center of the yarn guide opening portion coincides with the rotational center of the rotor as in the conventional case.

It is found from the drawings that the quality of the yarn is not affected by eccentrically providing the yarn guide opening portion with the sectional area of the fiber supply duct being kept constant. Further, it has been confirmed by other experiments that the quality of the yarn is little affected by the eccentricity of the yarn guide opening portion.

It is apparent from the results that the quality of the yarn is not affected by variations in tension. Further, considering that variations in tension may relate to the end breakage, the same spinning test as described above has been conducted. As a result of examination, it has been found that the end breakage is little affected by the eccentricity of the yarn guide opening portion.

The present invention is based on the aforementioned investigation.

Figure 15:
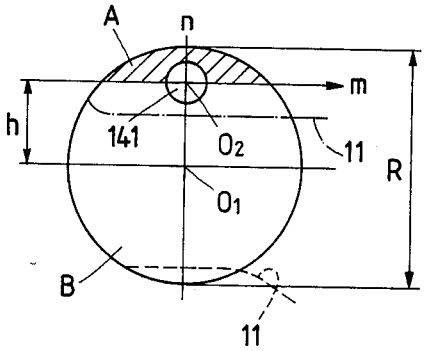

As an embodiment according to the invention, the yarn guide opening portion 141 is arranged eccentrically with respect to the rotational center axis of the rotor to thereby make it possible to reduce the variation in tension. As another embodiment as shown in FIG. 15, the end portion of the closing member is separated into a small-area region A and a large-area region B by a line m drawn to pass through the center $O_2$ of the yarn guide opening portion 141 perpendicularly to a line n which is drawn to connect the center of the yarn guide opening portion 141 with the rotational center $O_1$ of the rotor, so that the frictional resistance of the small-area region A is established so as to be larger than that of the large-area region B by means for controlling the frictional resistance.

Means for controlling the frictional resistance of the yarn at the region A are considered corresponding to the surface roughness, material and the like. For example, the surface roughness is provided by forming grooves or fine line on the surface of the region.

According to the aforementioned construction, the frictional resistance of the yarn becomes large at region A where the rotational radius of the yarn is reduced, so that the tension F of yarn at the region A increases in spite of the reduction of the rotational radius of the yarn. The same effect can be attained even when the frictional resistance of the region B is established to be smaller than that of the region A.

Figure 18:
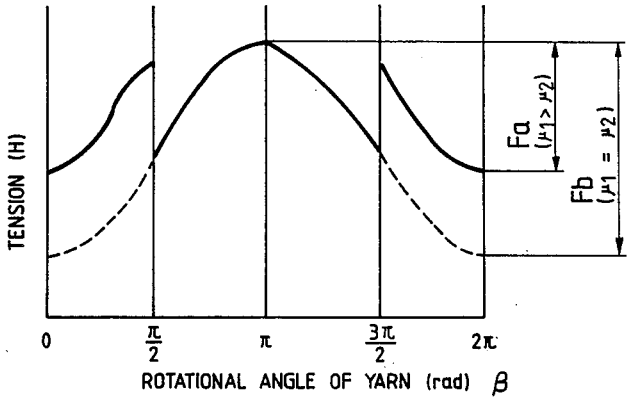

Accordingly, as shown in FIG. 18, the amplitude of the tension variations of the yarn is relatively reduced as compared with the case where the end portion of the closing member is formed uniformly (the broken line of FIG. 18), so that the tension variations can be reduced.

Figure 19:
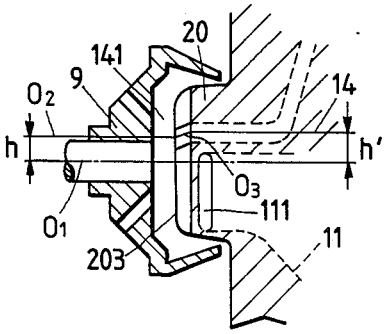
FIG. 19 is a partly sectional view of the closing member showing a fourth embodiment according to the present invention.
Figure 20:
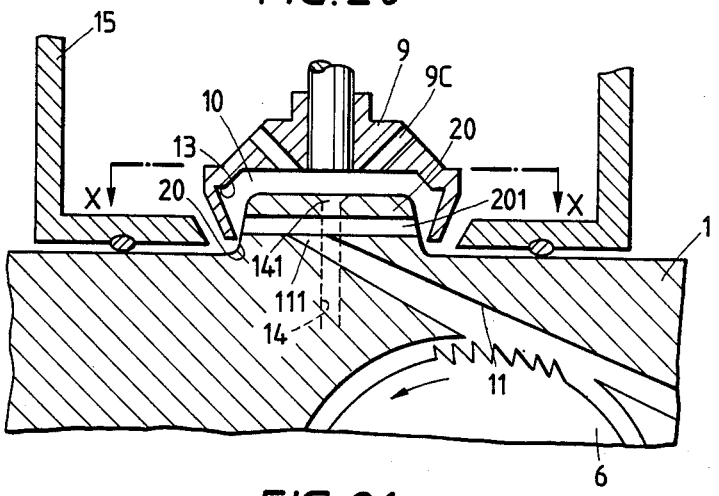
Figure 21:
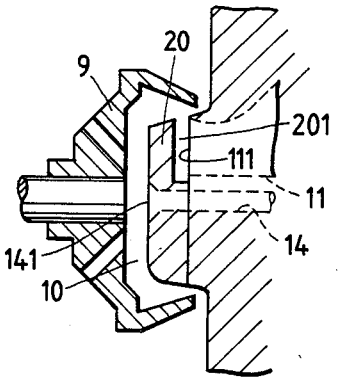
Figure 22:
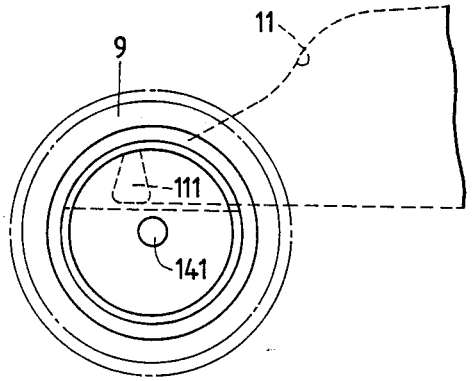
Figure 23:
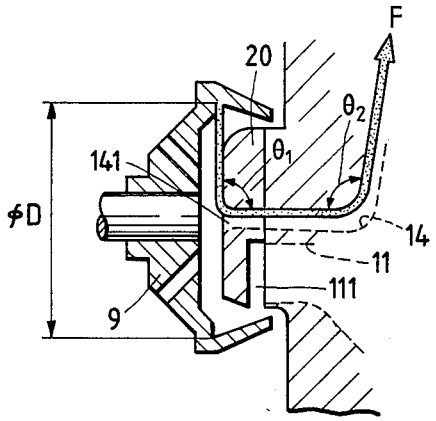
Figure 24:
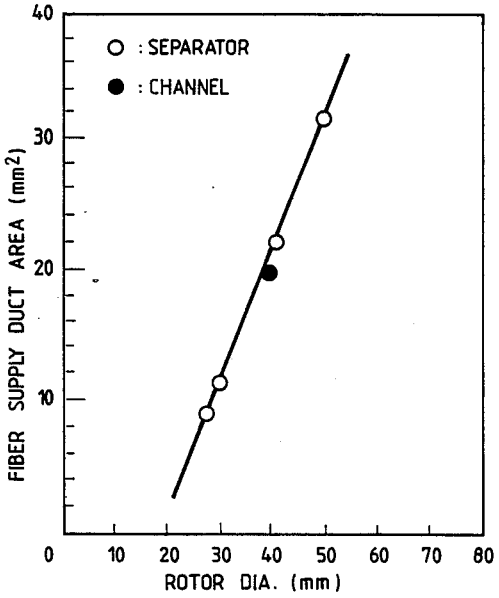

As a further embodiment as shown in FIG. 19, an upper end member having the guide yarn opening portion disposed near the rotational center of the rotor is provided in the end portion of the closing member opposite the bottom portion of the rotor, and the yarn guide opening portion is communicated with the yarn guide hole which is shaped like an inclined hole pointing to the rotational center of the rotor through the yarn guide opening portion.

According to the aforementioned construction, the center of yarn guide opening portion is arranged to point to a position near the rotational center axis of the rotor, so that the rotational radius of the yarn becomes substantially constant to thereby reduce the amplitude of the tension variations. In the case where the rotor is changed in shape, the relation between the greatest inner-diameter portion of the rotor and the yarn guide opening portion can be freely established only by changing the size or the like, of the upper end member.

According to the embodiment, the distance h between the rotational center axis of the rotor and the center of the yarn guide opening portion of the upper end member and the distance h′ between the rotational center axis of the rotor and the center of the yarn guide hole which passes through the boss portion can be freely changed as long as the relation:

$$0 \leqq h \leqq h'$$

can be satisfied. When, for example, h=0, the center of the yarn guide opening portion and the rotational center of the rotor are aligned, so that the rotational radius of the yarn becomes constant. Consequently, an advantage exists in that the tension applied to the yarn can be kept constant.

Although the embodiment has shown the case where the upper end member is provided so that the center of the yarn guide opening portion can point to a position near the rotational center axis of the rotor, it is to be understood that the invention is not limited to the specific embodiment and that the center of the yarn guide opening portion may be arranged to point to the position near the rotational center axis of the rotor without use of the upper end member. Accordingly, the amplitude of the tension variations can be reduced.

It is a matter of course that the aforementioned embodiments may be used in combination suitably.

In the spinning unit of an open-end spinning machine according to the present invention, fibers supplied into a spinning chamber of a rotor rotating at high speed through an enlarged fiber supply duct are collected and twisted in the form of a ribbon at a collecting portion of the rotor. The fiber ribbon thus collected is drawn out in the form of a yarn through a yarn guide hole from a yarn guide opening portion eccentrically arranged in the end portion of a closing member with respect to the rotational center of the rotor. As another method, the yarn guide opening portion may be arranged in the rotational center of the rotor so that the yarn can be drawn out through the yarn guide hole from the yarn guide opening portion.

According to the present invention, a side wall (which is near the center of the end surface of the closing member opposite to the bottom portion of the rotor or in other words near the center of the rotor) of the fiber supply duct piercing the closing member is arranged to be near to or over the rotational center of the rotor, so that the fiber supply duct is widened. Further, the center of the yarn guide opening portion which opens in the end surface of the closing member opposite to the bottom portion of the rotor is arranged eccentrically at a distance from the rotational center of the rotor. Accordingly, there is freedom as to the position and size of the fiber supply duct which opens toward the inner wall of the rotor. In spite of reduction of the diameter of the rotor with the progress of high-speed revolution of the rotor, it is unnecessary to reduce the fiber supply duct in size. Therefore, air resistance in the fiber supply duct does not increase, so that the fibers flying within the fiber supply duct can be smoothly supplied into the rotor. Consequently, in accordance with the invention, a good-quality yarn can be produced.

In other words, the rotor can be reduced in size and diameter by the aforementioned reason to thereby attain an remarkable improvement in high-speed revolution of the rotor.

EMBODIMENT 1

In this embodiment the spinning unit was constructed as shown in FIGS. 10 and 11, in which the fiber supply duct 11 piercing the closing member 20 opposite to the bottom portion of the rotor 9 was arranged as follows. The side wall 11*b* of the fiber supply duct 11, which was near the center of the end surface of the closing member opposite to the bottom portion of the rotor or in other words near the rotational center $O_1$ of the rotor, was extended to be across the rotational center of the rotor to thereby widen the fiber supply duct 11. The opening portion 111 of the fiber supply duct 11 was provided on the side surface of the closing member 20. The size of those portions was determined as shown in FIG. 4.

In FIGS. 10, 11 and 4, D represents the greatest diameter of the spinning chamber 10 of the rotor 9, R represents the diameter of the root portion of the closing member, r represents the diameter of the yarn guide opening portion, and t represents the thickness between the side wall of the yarn guide hole communicated with the yarn guide opening portion 141 and the outer wall of the closing member.

In this embodiment, the thickness t was not smaller than 0.5 mm and the widening factor $l_R$ was within a range represented by the relation:

$$(\tfrac{1}{2})(R-r)-2t < l_R \leqq (R-r)-2t.$$

In practice, a minimum thickness t is 0.5 mm.

In the spinning unit of this embodiment, the inner diameter of the fiber supply duct and its opening portion can be enlarged by the range of $l_R$ in spite of the reduction of the diameter of the rotor, as compared with the conventional spinning unit. Accordingly, the fibers flying within the fiber supply duct can be smoothly supplied into the rotor without an increase in air resistance, so that the quality of the yarn thus produced can be improved. Accordingly, the rotor can be operated at higher speed.

Figure 12:
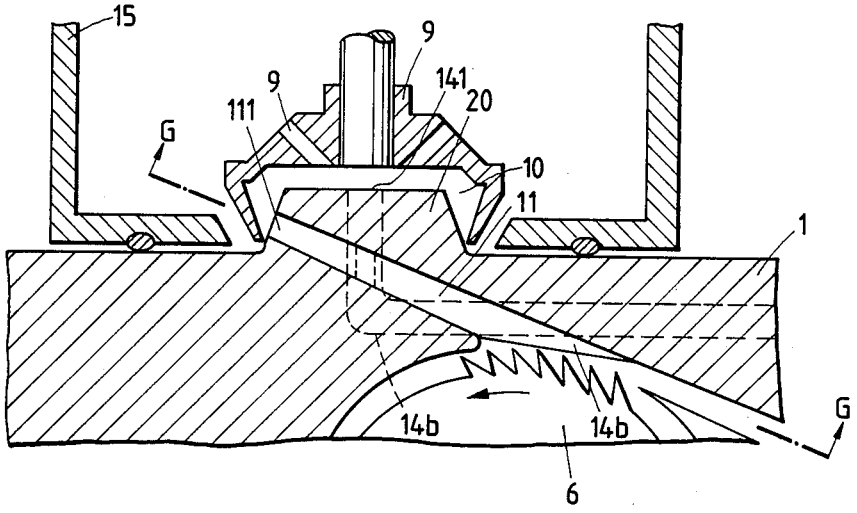
Figure 13:
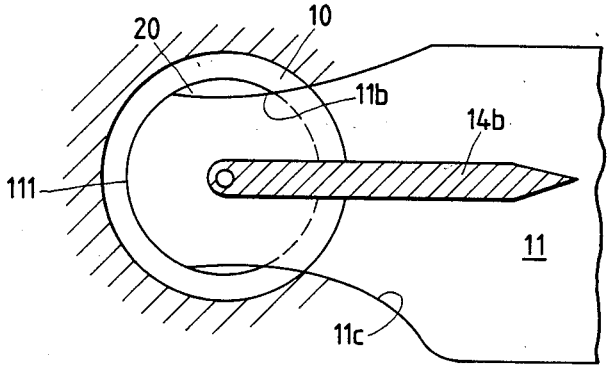

Because the yarn guide hole member 14a (FIG. 10) exists in the middle of the fiber supply duct 11 in this embodiment, the fibers flying within the fiber supply duct 11 may be caught by or may collide with the member 14a so that the fibers may be bent. To cope with this defect, as shown in FIGS. 12 and 13, a separator member 14b extended to the upstream of the fiber supply duct 11 or in other words extended near to the upper side of the combing roller can be provided on the side of the yarn guide hole member 14a to thereby smoothly separate the fiber supply duct 11 into two parts.

According to the aforementioned construction, the fibers are supplied with the stream which is separated smoothly into two parts by the separator member 14b, so the fibers released from the combing roller and flying within the fiber supply duct can be prevented from hitching or colliding, and disturbance of the stream in the fiber supply duct is prevented.

EMBODIMENT 2

In this embodiment the spinning unit was constructed as shown in FIG. 14. In the closing member 20 opposite to the bottom portion of the rotor 9, the center of the yarn guide opening portion 141 was eccentrically arranged at a distance h from the rotational center $o_1$ of the rotor to thereby enlarge the opening portion of the fiber supply duct within a range corresponding to the eccentricity. The opening portion 111 of the fiber supply duct 11 was provided on the side surface of the closing member 20.

FIG. 7 shows the relation in position between the yarn guide opening portion 141 and the fiber supply duct 11 in the end surface of the closing member 20 opposite to the bottom portion of the rotor 9.

In the drawings, D represents the greatest diameter of the spinning chamber 10 of the rotor 9, R represents the diameter of the root portion of the closing member, r represents the diameter of the yarn guide opening portion, and t represents the thickness between the side wall of the yarn guide hole communicated with the yarn guide opening portion 141 and the outer wall of the closing member. In this embodiment, the thickness t was not smaller than 0.5 mm and the distance h was within a range represented by the relation:

$$0<h\leqq(\tfrac{1}{2})(R-r)-t$$

In practice, the thickness t of 0.5 mm is required at minimum.

By use of the spinning unit of this embodiment, yarn samples of 20S of cotton 100% were produced in the same spinning condition except that the distance h between the center $O_2$ of the yarn guide opening portion and the rotational center $O_1$ of the rotor and the area of the opening portion 111 of the fiber supply duct were changed variously. Then the quality of the yarn samples was measured. The result of measurement is shown in the following Table.

TABLE

| No. | 1 | 2 | 3 | C |
|---|---|---|---|---|
| Eccentricity [(h/D/2)] | 0.01143 | 0.06143 | 0.1092 | 0 |
| Area of fiber supply ($mm^2$) | 11.45 | 13.53 | 15.62 | 9.36 |
| Strength of yarn (g) | 300.9 | 312.3 | 309.0 | 289.4 |
| Irregularity of thickness (CV %) | 15.9 | 15.6 | 15.4 | 16.2 |
| | Present Invention | | Prior Art | |

As shown in the Table, the eccentricity was represented by h/(D/2). In this embodiment, D was 28 mm and the distance h in Sample Nos. 1, 2 and 3 had values of 0.16, 0.86 and 1.53 mm, respectively (in which the revolution speed of the rotor was 120,000 rpm). The term "Area of fiber supply" used in Table means an area of the opening portion 111 of the fiber supply duct. In the Table, No. C having an eccentricity of 0 shows the prior art (in which the revolution speed of the rotor is 80,000 rpm).

It is apparent from Table that in accordance with the present invention, a spinning excellent in terms of the strength of the yarn and the irregularity of thickness thereof can be made. FIGS. 8 and 9 show the results measured in the same manner as described above.

In the spinning unit of this embodiment, the inner diameter of the fiber supply duct and its opening portion can be enlarged by the range of h in spite of the reduction of the diameter of the rotor, as compared with the conventional spinning unit. Accordingly, the fibers flying within the fiber supply duct can be smoothly supplied into the rotor without an increase in air resistance, so that the quality of the yarn thus produced can be improved. Accordingly, the rotor can be operated at higher speed.

EMBODIMENT 3

In this embodiment, as shown in FIG. 15, the region of the end surface of the closing member opposite to the bottom portion of the rotor was separated into two parts, a small area and a large area with respect to the yarn guide opening portion 141, so that the frictional resistance of the former against the yarn was made larger than that of the latter.

More particularly, as shown in the drawing, a line n was drawn between the rotational center $O_1$ of the rotor and the center $O_2$ of the yarn guide opening portion in the upper end surface of the closing member, and a line m was drawn perpendicularly to the line n through the center $O_2$ of the yarn guide opening portion, so that the end surface of the closing member was separated by the line m into a small-area region A and a large-are region B. The frictional resistance of the small-area region A was established so to be larger than that of the large-area region B.

Figure 16:
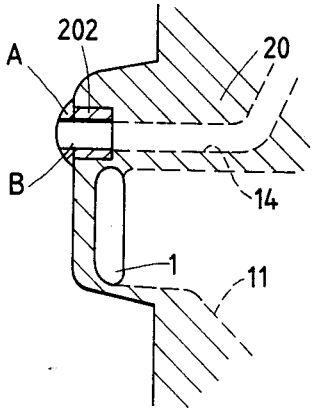

As shown in FIG. 16, an umbrella-like member 202 was provided in the yarn guide opening portion of the closing member so that the difference in coefficient of friction between the regions A and B was established. More particularly, the difference in coefficient of friction was constructed by forming the umbrella-like member 202 of S45C material and by providing a plurality of fine grooves with a depth of about 100 μm only in the region A.

According to this embodiment, the frictional resistance of the region A is larger than that of the region B, so that the tension F of the yarn in the region A can be increased in spite of the reduction of the rotational radius of the yarn. Therefore, the amplitude of tension variations is reduced as compared with the case where the plurality of fine grooves are not provided.

Figure 17:
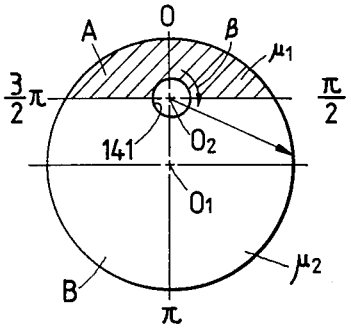

FIGS. 17 and 18 which relate to the variations in tension as described above, show the relation between the rotational angle (rad $\beta$) of the yarn and the tension F thereof. The tension F of the yarn changes with the progress of the rotational angle $\beta$ thereof as shown in FIG. 18, when the rotational angle $\beta$ of the yarn is set clockwise and $\mu_1$ and $\mu_2$ represent the coefficient of frictions of the regions A and B, respectively, as shown in FIG. 17. In the case of $\mu_1 > \mu_2$, the tension F changes as represented by the solid line. In the case of $\mu_1 = \mu_2$, the tension F changes as indicated by the broken line. In short, the amplitude Fa in the former case is smaller than that (Fb) in the latter case.

Although this embodiment has shown the case where the difference in frictional resistance between the regions A and B is established by providing the umbrella-like member 202, it is to be understood that the invention is not limited to the specific embodiment discussed above and that the difference in frictional resistance may be established directly in the end surface of the closing member without use of the umbrella-like member.

EMBODIMENT 4

In this embodiment as shown in FIG. 19, an upper end member 203 in which the center $O_2$ of the yarn guide opening portion 141 was eccentrically arranged by a distance h from the rotational center $O_1$ of the rotor 9 was provided in the upper end of the closing member 20. Then the center $O_3$ of the yarn guide hole piercing the closing member 20 was eccentrically arranged by a distance h' from the rotation center $O_1$ of the rotor so that the yarn guide opening portion 141 was communicated with the yarn guide hole 14.

The yarn guide opening portion 141 thus arranged on the upper end member 203 was provided in the form of an inclined hole pointing to the rotational center of the rotor. The opening portion 111 of the fiber supply duct 11 was provided so as to be enlarged as compared with the prior art.

In this embodiment, the values of respective constants are as follows: h is 1.53 mm, h' is 3 mm, the diameter of the yarn guide opening portion is 2 mm, the diameter of the yarn guide hole is 5 mm, and the area of the opening portion of the fiber supply duct is 15.62 $mm^2$. The upper end member 203 was fixed to the upper end of the closing member 20 by screwing (no shown).

According to this embodiment, the center of the yarn guide opening portion points to the rotational center of the rotor, so that the rotational radius of the yarn is kept substantially constant to thereby reduce variations in amplitude of tension. Further, only replacement of the upper end member 203 suffices to cope with the case where the shape of the rotor is changed.

Obviously, numerous modifications and variations of the present invention are possible in light of the above teachings. It is therefore to be understood that within the scope of the appended claims, the invention may be practiced otherwise than as specifically described herein.

What is claimed is:

1. A spinning unit of an open-end spinning machine comprising:

a rotor having an inner wall, a bottom portion and an open end opposite to said bottom portion and being arranged to rotate about a center axis perpendicular to said bottom portion; and a stationary closing member projecting into a spinning chamber of said rotor to extend over the rotational axis of the rotor and thereby close the open end of said rotor and being provided with a fiber supply duct which opens toward said inner wall of said rotor, said fiber supply duct having one side wall located at one side of said closing member and an opposite side wall located at an opposite side of said closing member and a yarn guide hole which opens at an end surface thereof opposite said bottom portion of said rotor; wherein said fiber supply duct is arranged in said closing member so that the diameter of said fiber supply duct is not larger than 90 percent of the diameter of said closing member.

2. A spinning unit of an open-end spinning machine according to claim 1, wherein said yarn guide hole has a yarn guide opening portion which opens toward said bottom portion of said rotor, the center of said yarn guide opening portion being eccentrically arranged at a predetermined distance from the rotational center of said rotor.

3. A spinning unit of an open-end spinning machine according to claim 2, wherein the distance between said yarn guide opening portion and an opposite peripheral wall of said closing member is at least 0.5 mm.

4. A spinning unit of an open-end spinning machine according to claim 2, wherein an end portion of said closing member is separated into a small-area region positioned a first distance from said yarn guide opening portion to the inner wall of said rotor and a large-area region positioned a second distance from said yarn guide opening portion to the inner wall of said rotor as determined by a first line drawn to pass through the center of said yarn guide opening portion and which is perpendicular to a second line drawn to connect the rotational center axis of said rotor with a center of said yarn guide opening portion, and means for controlling frictional resistance so that the frictional resistance and the tension of the yarn in said small-area region is larger than that of said large-area region.

5. A spinning unit of an open-end spinning machine according to claim 2, wherein an upper end member having said guide yarn opening portion disposed near the rotational center of said rotor is provided in the end portion of said closing member opposite to said bottom portion of said rotor, and in that said yarn guide opening portion is communicated with said yarn guide hole which is shaped like an inclined hole pointing to the rotational center of said rotor through said yarn guide opening portion.

6. A spinning unit of an open-end spinning machine according to claim 1, wherein an upper end member having said yarn guide opening portion disposed near the rotational center of said rotor is provided in the end portion of said closing member opposite to said bottom portion of said rotor, and said yarn guide opening portion is communicated with said yarn guide hole and wherein said yarn guide hole includes an inclined hole directed to the rotational center of said rotor through said yarn guide opening portion.

7. A spinning unit of a open-end spinning machine according to claim 6, wherein said yarn guide hole member is provided in the center of said fiber supply duct and which comprises a separator member which extends in said fiber supply duct from said yarn guide hole member to a position upstream of said fiber supply duct.

* * * * *

UNITED STATES PATENT AND TRADEMARK OFFICE

CERTIFICATE OF CORRECTION

PATENT NO. : 4,879,873

DATED : Nov. 14, 1989

INVENTOR(S) : Susumu Kawabata, et al

It is certified that error appears in the above-identified patent and that said Letters Patent is hereby corrected as shown below:

On the title page:

The total number of Drawing Sheets is incorrectly recorded, should be: --10--

The Priority information is incorrect recorded "Jul. 31, 1987 [JP] Japan.....62-93065" should be:

--Jul. 31, 1987 [JP] Japan.....62-193065--

Signed and Sealed this

Eleventh Day of December, 1990

*Attest:*

HARRY F. MANBECK, JR.

*Attesting Officer*

*Commissioner of Patents and Trademarks*